US012685394B1

(12) United States Patent
Long et al.

(10) Patent No.: US 12,685,394 B1
(45) Date of Patent: Jul. 21, 2026

(54) HUMAN-PET SHARED COLLAPSIBLE CHAIR

(71) Applicant: Guangzhou Mibo Zhilian Technology Co., Ltd., Guangdong (CN)

(72) Inventors: Ziyi Long, Beijing (CN); Weilong Zhang, Guangzhou (CN)

(73) Assignee: Guangzhou Mibo Zhilian Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/369,285

(22) Filed: Oct. 26, 2025

(30) Foreign Application Priority Data

Aug. 18, 2025 (CN) ..... 202521754525.4

(51) Int. Cl.
*A47C 4/28* (2006.01)
*A47C 15/00* (2006.01)
*A47C 4/30* (2006.01)

(52) U.S. Cl.
CPC ..... *A47C 4/286* (2013.01); *A47C 15/004* (2013.01); *A47C 4/30* (2013.01)

(58) Field of Classification Search
CPC ..... A47C 1/124; A47C 4/30; A47C 4/286; A47C 4/42; A47C 4/48; A47C 15/004
See application file for complete search history.

(56) References Cited

U.S. PATENT DOCUMENTS 4,846,204 A * 7/1989 Sok Kyu ..... E04H 15/50 52/109
5,570,928 A * 11/1996 Staunton ..... A47C 11/005 297/44
6,925,664 B1 * 8/2005 Twigg ..... A01K 1/034 5/112
7,648,196 B2 * 1/2010 Degelman ..... A47C 7/66 297/184.11
8,245,332 B2 * 8/2012 Yul ..... A47C 17/16 5/174
9,131,778 B2 * 9/2015 Jin ..... A47C 17/72
10,334,954 B1 * 7/2019 Horowitz ..... A47C 4/286
10,758,054 B2 * 9/2020 Wang ..... A47C 11/005
10,871,007 B1 * 12/2020 Tsai ..... E04H 15/50
11,278,121 B1 * 3/2022 Tsai ..... A47C 4/286
11,540,639 B2 * 1/2023 Holland ..... A47C 1/124
12,274,377 B2 * 4/2025 Tamburro ..... A47C 17/645
2004/0207240 A1 * 10/2004 Tondino ..... A47C 4/286 297/248
2021/0145179 A1 * 5/2021 Kong ..... A47C 7/66
2024/0335043 A1 * 10/2024 Mays ..... A47C 1/124

* cited by examiner

*Primary Examiner* — Philip F Gabler
(74) *Attorney, Agent, or Firm* — RAYCHAN PATENT FIRM; Raymond Y Chan

(57) ABSTRACT

A human-pet shared collapsible chair includes: a first collapsible linkage mechanism; a second collapsible linkage mechanism, including a third seat rod, and a fourth seat rod, where a rotating shaft member is provided in a middle of each of the third seat rod and the fourth seat rod; a central seat rod; and a first joint pivoting module, a second joint pivoting module, and a third joint pivoting module, where the first collapsible linkage mechanism and the second collapsible linkage mechanism are centered on the central seat rod, and are capable of pivoting relative to each other by the first joint pivoting module, the second joint pivoting module, and the third joint pivoting module to allow the human-pet shared collapsible chair to jointly switch between a deployed-for-use state and a collapsed-for-storage state.

10 Claims, 5 Drawing Sheets

HUMAN-PET SHARED COLLAPSIBLE CHAIR

CROSS REFERENCE OF RELATED APPLICATION

This application is a non-provisional application that claims the benefit of priority under 35U.S.C. § 119 to a Chinese application number 202521754525.4, filed Aug. 18, 2025, which is incorporated herewith by reference in its entirety.

BACKGROUND OF THE PRESENT INVENTION

Field of Invention

The present application relates to the field of outdoor products, and more particularly to a human-pet shared collapsible chair.

Description of Related Arts

With the improvement of living standards, more and more people keep pets, and people also prefer to bring pets along when engaging in outdoor activities. Currently, the conventional collapsible human chair and collapsible pet bed on the market are independent of and separated from each other, and thus people and pets are separated from each other during use, resulting in limited human-pet interaction. Additionally, there is a need for separate handling during deploying and storage, making it impossible to achieve simultaneous deploying or storage of the collapsible human chair and the collapsible pet bed in one go. Moreover, since the collapsible human chair is independent of and separate from the collapsible pet bed, the structure is not compact, resulting in a great space occupation during both use and storage.

SUMMARY OF THE PRESENT INVENTION

The present application aims to solve the above technical problems of the prior art, and provides a human-pet shared collapsible chair, with the specific technical solution as follows.

A human-pet shared collapsible chair, includes: a first collapsible linkage mechanism, the first collapsible linkage mechanism including a first set of front crossing struts and a first set of rear crossing struts arranged opposite the first set of front crossing struts, the first set of front crossing struts including a first strut and a second strut rotationally connected to the first strut, the first strut including a first upper end and a first lower end arranged opposite each other, the second strut including a second upper end and a second lower end arranged opposite each other, the first set of rear crossing struts including a third strut and a fourth strut rotationally connected to the third strut, the third strut including a third upper end and a third lower end arranged opposite each other, and the fourth strut including a fourth upper end and a fourth lower end arranged opposite each other; a second collapsible linkage mechanism, the second collapsible linkage mechanism including a second set of front crossing struts, a second set of rear crossing struts, and a third seat rod and a fourth seat rod each connected to the second set of front crossing struts and the second set of rear crossing struts, the second set of front crossing struts including a fifth strut and a sixth strut rotationally connected to the fifth strut, the fifth strut including a fifth upper end and a fifth lower end arranged opposite each other, the sixth strut including a sixth upper end and a sixth lower end arranged opposite each other, the second set of rear crossing struts including a seventh strut and an eighth strut rotationally connected to the seventh strut, the seventh strut including a seventh upper end and a seventh lower end arranged opposite each other, the eighth strut including an eighth upper end and an eighth lower end arranged opposite each other, the third seat rod including a third seat rod upper end and a third seat rod lower end arranged opposite each other, the fourth seat rod including a fourth seat rod upper end and a fourth seat rod lower end, where a rotating shaft member is provided in a middle of each of the third seat rod and the fourth seat rod to allow the third seat rod and the fourth seat rod to bend relative to themselves when the human-pet shared collapsible chair is in a collapsed state; a central seat rod, the central seat rod including a central seat rod upper end and a central seat rod lower end arranged opposite each other; a first joint pivoting module, the first lower end, the sixth lower end, and the third seat rod lower end being rotatably connected to the first joint pivoting module; a second joint pivoting module, the third lower end, the central seat rod lower end, and the eighth lower end being rotatably connected to the second joint pivoting module; and a third joint pivoting module, the second upper end, the third upper end, and the central seat rod upper end being connected to the third joint pivoting module; where the first collapsible linkage mechanism and the second collapsible linkage mechanism are centered on the central seat rod, and are capable of pivoting relative to each other by means of the first joint pivoting module, the second joint pivoting module, and the third joint pivoting module to allow the human-pet shared collapsible chair to jointly switch between a deployed-for-use state and a collapsed-for-storage state.

Further, the human-pet shared collapsible chair may include: a transverse bracing rod, the transverse bracing rod comprising a first rod segment and a second rod segment pivotally connected to the first rod segment, an end of the first rod segment facing away from the second rod segment being pivotally connected to the seventh strut, and an end of the second rod segment facing away from the first rod segment being pivotally connected to the eighth strut; wherein the second set of rear crossing struts has a locked state and an unlocked state; when the first rod segment is rotated to be in collinear alignment with the second rod segment, the transverse bracing rod, the seventh strut and the eighth strut enclose a triangle for bringing the second set of rear crossing struts into the locked state; and when the first rod segment is bent relative to the second rod segment, constraint on the second set of rear crossing struts is released, at this point, a seventh upper portion and an eighth upper portion are capable of moving close to each other, and the second set of rear crossing struts is brought into the unlocked state.

Further, the first collapsible linkage mechanism may include: a first backrest rod, the first backrest rod comprising a first backrest rod upper end and a first backrest rod lower end; a second backrest rod, the second backrest rod comprising a second backrest rod upper end and a second backrest rod lower end, the first backrest rod lower end and the second backrest rod lower end being pivotably connected to the second lower end and the first lower end, respectively, and the first backrest rod upper end and the second backrest rod upper end being pivotably connected to the third upper end and the fourth upper end, respectively; a first seat rod, the first seat rod comprising a first seat rod upper end and a first seat rod lower end, the first seat rod upper end and the central seat rod upper end being pivotably connected to the first upper end and the second upper end, respectively, and the first seat rod lower end and the central seat rod lower end being pivotably connected to the fourth lower end and the third lower end, respectively, wherein the second backrest rod lower end is pivotably connected to the first joint pivoting module; and the second collapsible linkage mechanism may include: a second seat rod, the second seat rod comprising a second seat rod upper end and a second seat rod lower end, the second seat rod upper end and the central seat rod upper end being pivotably connected to the sixth upper end and the fifth upper end, respectively, the second seat rod lower end and the central seat rod lower end being pivotably connected to the seventh lower end and the eighth lower end, respectively, the third seat rod upper end and the fourth seat rod upper end being pivotably connected to the seventh upper end and the eighth upper end, respectively, and the fourth seat rod lower end being pivotably connected to the fifth lower end; and the first backrest rod and the second backrest rod are equal in length, the first seat rod, the central seat rod, the second seat rod, the third seat rod and the fourth seat rod are equal in length and less than the first backrest rod and the second backrest rod in length.

Further, the human-pet shared collapsible chair may include: a first connecting rod, a central connecting rod, a second connecting rod, a third connecting rod, and a fourth connecting rod, and a first slider, a central slider, a second slider, a third slider, and a fourth slider, wherein an upper end of the first connecting rod is pivotably connected to the first seat rod, a lower end of the first connecting rod is pivotably connected to the first slider, and the first slider is slidably connected to the first backrest rod; an upper end of the central connecting rod is pivotably connected to the central seat rod, a lower end of the central connecting rod is pivotably connected to the central slider, and the central slider is slidably connected to the second backrest rod; an upper end of the second connecting rod is pivotably connected to the second seat rod, a lower end of the second connecting rod is pivotably connected to the second slider, and the second slider is slidably connected to the fourth seat rod; an upper end of the third connecting rod is pivotably connected to the third seat rod, a lower end of the third connecting rod is pivotably connected to the third slider, and the third slider is slidably connected to the central seat rod; and an upper end of the fourth connecting rod is pivotably connected to the fourth seat rod, a lower end of the fourth connecting rod is pivotably connected to the fourth slider, and the fourth slider is slidably connected to the second seat rod.

Further, the first joint pivoting module further comprises a pivot base, the pivot base comprising an inner wall and an outer wall, each of the first lower end, the fourth lower end, the second backrest rod lower end and the third seat rod lower end being pivotably connected to the inner wall, and the outer wall being configured for contact with a ground.

Further, the human-pet shared collapsible chair may include: a plurality of pivot members for pivotally connecting the first upper end to the first seat rod, the second upper end to the central seat rod, the third upper end to the first backrest rod, the fourth upper end to the second backrest rod, the fifth upper end to the central seat rod, the sixth upper end to the second seat rod, the seventh upper end to the third seat rod, and the eighth upper end to the fourth seat rod.

Further, the human-pet shared collapsible chair may include: a seat fabric, the seat fabric being removably arranged on the first collapsible linkage mechanism and the second collapsible linkage mechanism.

Further, a storage bag is provided on an outer side of the first collapsible linkage mechanism.

Further, a neck rest is provided on the seat fabric on the first collapsible linkage mechanism for bearing a human neck.

Further, the seat fabric is made of an oxford cloth material.

According to the present invention, the human-pet shared collapsible chair combines a collapsible human chair with a collapsible pet bed, during collapsing, the part for a human and the part for a pet can be collapsed simultaneously, such that the collapsing can be completed in one go, the structure is compact, and the collapsing process is smooth, saving time and effort; after being collapsed, the use space and the storage space are also reduced; and when being deployed for use outdoors, the human and the pet are close to each other to enable easier interaction, the shifting or tipping over of the collapsible chair by the pet can also be prevented, and the support rigidity is strong, thereby greatly improving the user experience.

The foregoing overview is intended only to explain the description and is not to be construed as limiting. In addition to the schematic aspects, embodiments, and features described above, further aspects, embodiments, and features will become apparent by reference to the drawings and the following detailed description.

BRIEF DESCRIPTION OF THE DRAWINGS

In accompanying drawings, In the drawings, unless otherwise specified, the same reference numerals across multiple drawings denote the same or similar parts or elements. These drawings are not necessarily drawn to scale. It should be understood that the drawings merely depict certain embodiments disclosed in the present invention and are not to be construed as limiting the scope of the present invention.

LIST OF REFERENCE NUMBERS

Figure 1:
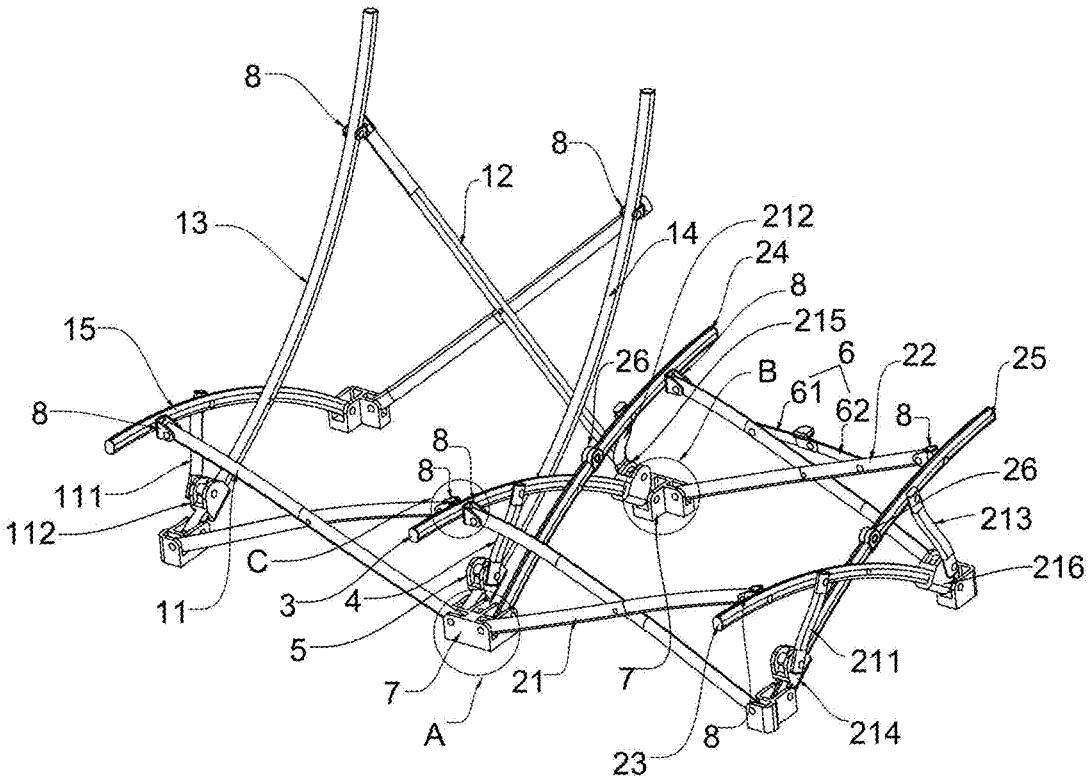
FIG. 1 shows a perspective view of a human-pet shared collapsible chair according to one of the embodiments in a deployed-for-use state.

1, first collapsible linkage mechanism; 11, first set of front crossing struts; 111, first connecting rod; 112, first slider; 113, first strut; 1131, first upper end; 1132, first lower end; 114, second strut; 1141, second upper end; 1142, second lower end; 12, first set of rear crossing struts; 121, third strut; 1211, third upper end; 1212, third lower end; 122, fourth strut; 1221, fourth upper end; 1222, fourth lower end; 13, first backrest rod; 131, first backrest rod upper end; 132, first backrest rod lower end; 14, second backrest rod; 141, second backrest rod upper end; 142, second backrest rod lower end; 15, first seat rod; 151, first seat rod upper end; 152, first seat rod lower end; 2, second collapsible linkage mechanism; 21, second set of front crossing struts; 211, second connecting rod; 212, third connecting rod; 213, fourth connecting rod; 214, second slider; 215, third slider; 216, fourth slider; 217, fifth strut; 2171, fifth upper end; 2172, fifth lower end; 218, sixth strut; 2181, sixth upper end; 2182, sixth lower end; 22, second set of rear crossing struts; 221, seventh strut; 2211, seventh upper end; 2212, seventh lower end; 222, eighth strut; 2221, eighth upper end; 2222, eighth lower end; 23, second seat rod; 231, second seat rod upper end; 232, second seat rod lower end; 24, third seat rod; 241, third seat rod upper end; 242, third seat rod lower end; 25, fourth seat rod; 251, fourth seat rod upper end; 252, fourth seat rod lower end; 26, rotating shaft member; 3, central seat rod; 31, central seat rod upper end; 32, central seat rod lower end; 4, central connecting rod; 5, central slider; 6, transverse bracing rod; 61, first rod segment; 62, second rod segment; 7, pivot base; 8, pivot member; 9, seat fabric; 91, storage bag; 92, neck rest; a, first joint pivoting module; b, second joint pivoting module; c, third joint pivoting module.

DETAILED DESCRIPTION OF THE PREFERRED EMBODIMENT

Various different implementations or embodiments carrying out the subject matter and technical solutions are disclosed as follows. To simplify the disclosure, specific examples of elements and arrangements will be described below. Of course, these examples are merely exemplary, and are not intended to limit the scope of protection of the present application. For example, a first feature recorded later in the specification being formed above or over a second feature can include an implementation of forming a direct contact of the first and second features, and can also include an implementation of forming an additional feature between the first feature and the second feature such that the first and second features may not be in direct contact. In addition, reference numerals and/or letters may be repeated in different examples in the disclosure. This repetition is for the sake of brevity and clarity, and does not itself represent the relationship between the various implementations and/or structures to be discussed. Further, when a first element is described as being connected or coupled to a second element, the description includes an implementation in which the first and second elements are directly connected or coupled to each other, and also includes an implementation in which the first and second elements are indirectly connected or coupled to each other by using one or more other intervening elements.

Only some exemplary embodiments are briefly described below. As can be appreciated by those skilled in the art, modifications may be made to the described embodiments in various ways without departing from the spirit or scope of the present application. Therefore, the accompanying drawings and the description are considered as exemplary in nature rather than limiting.

Figure 2:
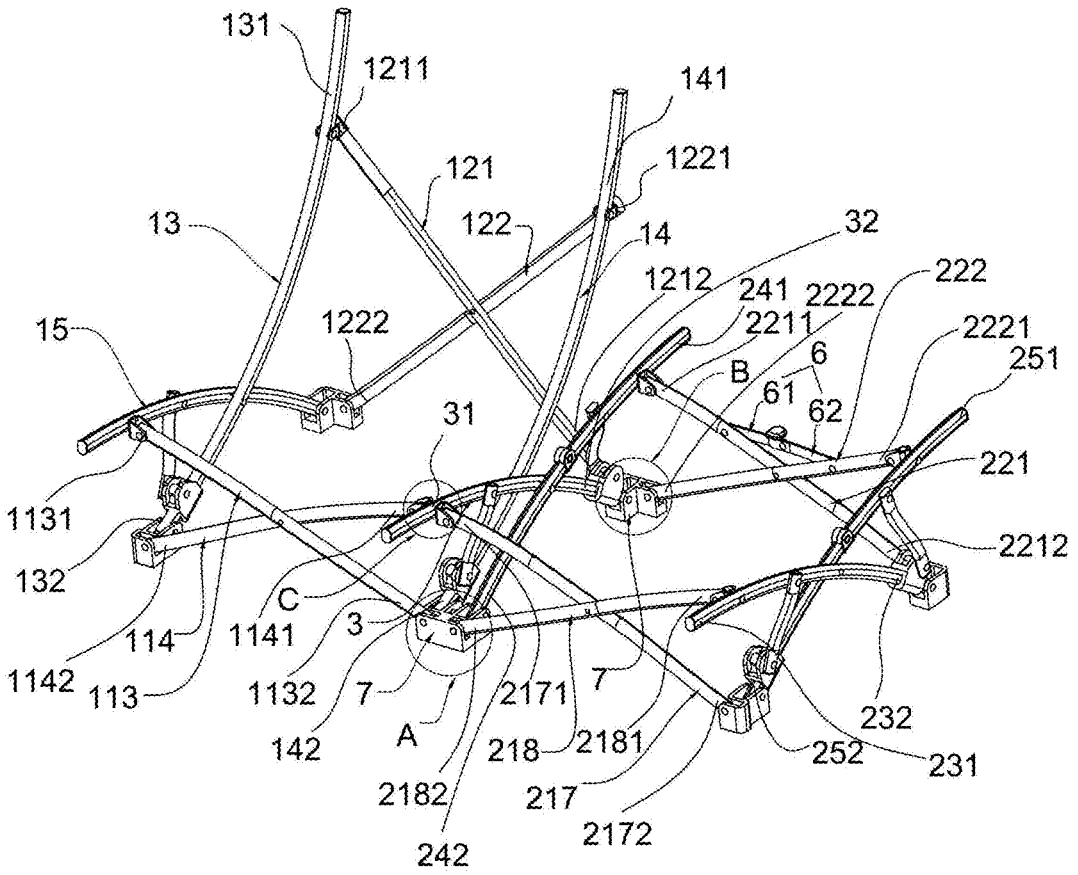
FIG. 2 shows a perspective view of the same human-pet shared collapsible chair as in FIG. 1 in the deployed-for-use state.
Figure 3:
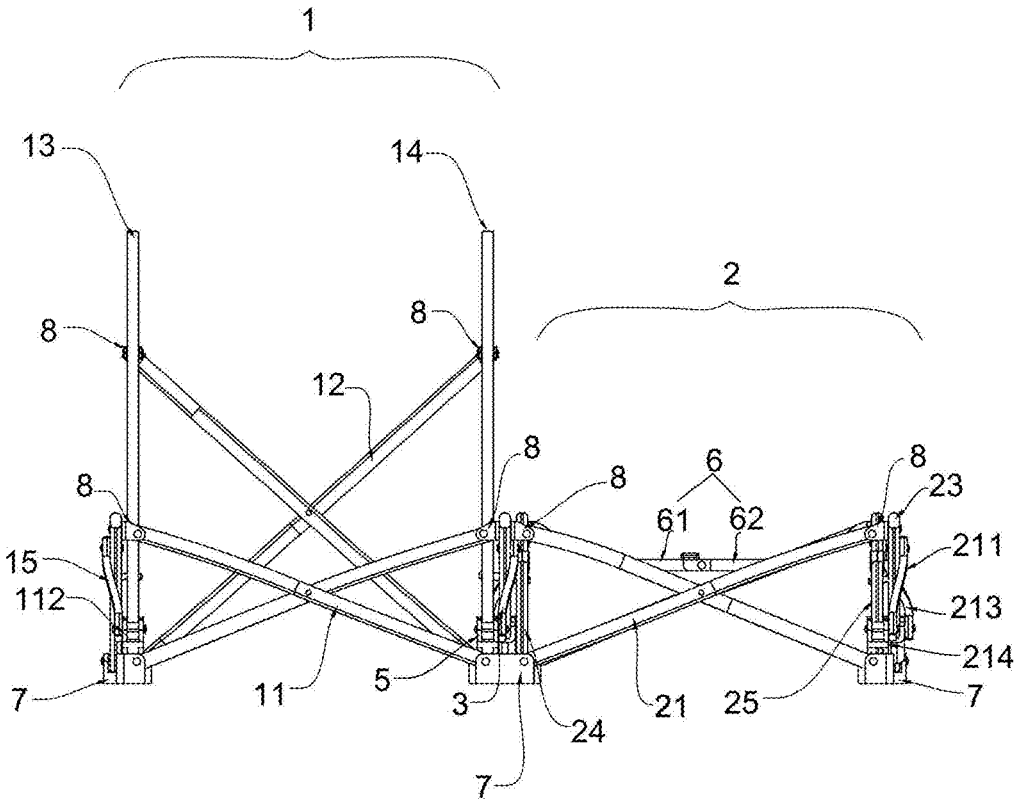
FIG. 3 shows a front view of a human-pet shared collapsible chair according to one of the embodiments in a deployed-for-use state.
Figure 4:
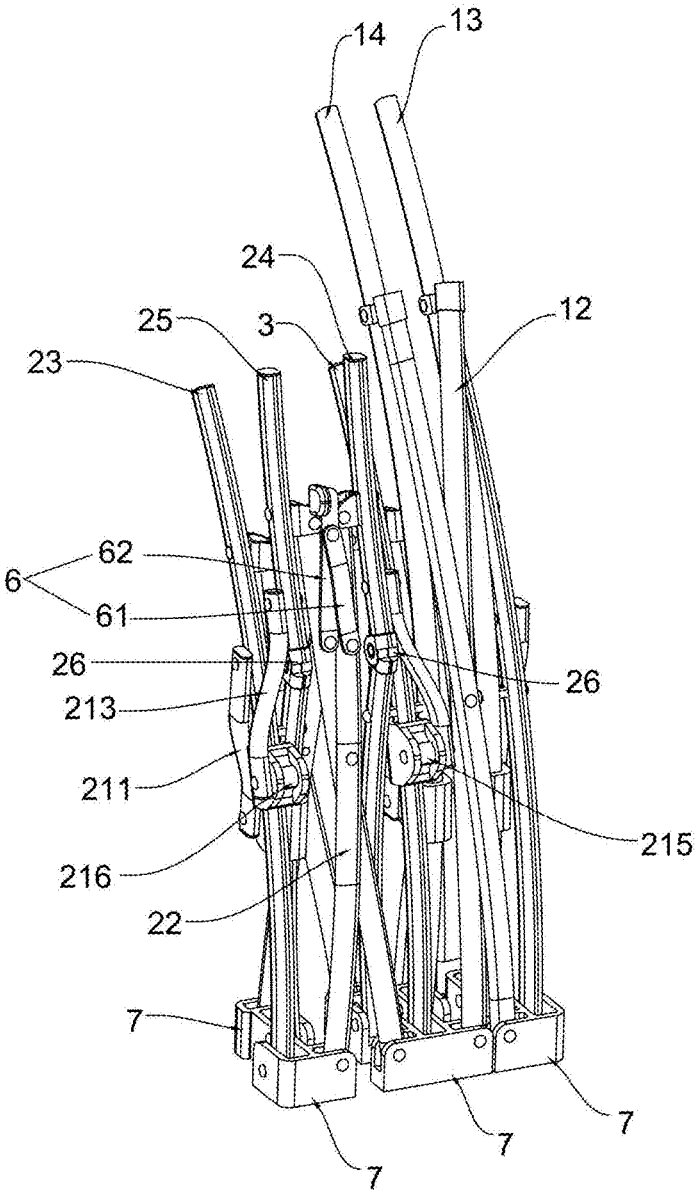
FIG. 4 shows a perspective view of a human-pet shared collapsible chair according to one of the embodiments in an collapsed-for-storage state.

Referring to FIGS. 1 to 3, in some embodiments, a human-pet shared collapsible chair includes: a first collapsible linkage mechanism1, the first collapsible linkage mechanism1 including a first set of front crossing struts 11 and a first set of rear crossing struts 12 arranged opposite the first set of front crossing struts 11, the first set of front crossing struts 11 including a first strut 113 and a second strut 114 rotationally connected to the first strut 113, the first strut 113 including a first upper end 1131 and a first lower end 1132 arranged opposite each other, the second strut 114 including a second upper end 1141 and a second lower end 1142 arranged opposite each other, the first set of rear crossing struts 12 including a third strut 121 and a fourth strut 122 rotationally connected to the third strut 121, the third strut 121 including a third upper end 1211 and a third lower end 1212 arranged opposite each other, and the fourth strut 122 including a fourth upper end 1221 and a fourth lower end 1222 arranged opposite each other; a second collapsible linkage mechanism 2, the second collapsible linkage mechanism 2 including a second set of front crossing struts 21, a second set of rear crossing struts 22, and a third seat rod 24 and a fourth seat rod 25 each connected to the second set of front crossing struts 21 and the second set of rear crossing struts 22, the second set of front crossing struts 21 including a fifth strut 217 and a sixth strut 218 rotationally connected to the fifth strut 217, the fifth strut 217 including a fifth upper end 2171 and a fifth lower end 2172 arranged opposite each other, the sixth strut 218 including a sixth upper end 2181 and a sixth lower end 2182 arranged opposite each other, the second set of rear crossing struts 22 including a seventh strut 221 and an eighth strut 222 rotationally connected to the seventh strut 221, the seventh strut 221 including a seventh upper end 2211 and a seventh lower end 2212 arranged opposite each other, the eighth strut 222 including an eighth upper end 2221 and an eighth lower end 2222 arranged opposite each other, the third seat rod 24 including a third seat rod upper end 241 and a third seat rod lower end 242 arranged opposite each other, the fourth seat rod 25 including a fourth seat rod upper end 251 and a fourth seat rod lower end 252, where a rotating shaft member 26 is provided in a middle of each of the third seat rod 24 and the fourth seat rod 25 to allow the third seat rod 24 and the fourth seat rod 25 to bend relative to themselves when the human-pet shared collapsible chair is in a collapsed state; a central seat rod 3, the central seat rod 3 including a central seat rod upper end 31 and a central seat rod lower end 32 arranged opposite each other; a first joint pivoting module a, the first lower end 1132, the sixth lower end 2182, and the third seat rod lower end 242 being rotatably connected to the first joint pivoting module a; a second joint pivoting module b, the third lower end 1212, the central seat rod lower end 32, and the eighth lower end 2222 being rotatably connected to the second joint pivoting module b; and a third joint pivoting module c, the second upper end 1141, the third upper end 1211, and the central seat rod upper end 31 being connected to the third joint pivoting module c; where the first collapsible linkage mechanism1 and the second collapsible linkage mechanism 2 are centered on the central seat rod 3, and are capable of pivoting relative to each other by means of the first joint pivoting module a, the second joint pivoting module b, and the third joint pivoting module c, to allow the human-pet shared collapsible chair to jointly switch between a deployed-for-use state and a collapsed-for-storage state.

It can be understood that the first collapsible linkage mechanism1 is configured to bear a human, the second collapsible linkage mechanism 2 is configured to bear a pet, the first set of front crossing struts 11, the first set of rear crossing struts 12, the second set of front crossing struts 21, and the second set of rear crossing struts 22 are each composed of two struts, and centers of the two struts are rotatably connected to each other. The first collapsible linkage mechanism1 and the second collapsible linkage mechanism 2 are structured such that they can create linked collapsing and deploying movements, are simple and effortless to operate, and can provide stable bearing for a human or pet during deploying for use. Since the first collapsible linkage mechanism1 and the second collapsible linkage mechanism 2 are jointly connected to the first joint pivoting module a, the second joint pivoting module b, the third joint pivoting module c, and the central seat rod 3, the second collapsible linkage mechanism 2 will be collapsed synchronously upon collapsing of the first collapsible linkage mechanism1, and vice versa. This thus makes the collapsing-for-storage process of the human-pet shared collapsible chair easier, and during storing and moving, no separate operations are required, the operations are synchronized, which saves manpower, reduces occupied space, and provides a better outdoor camping experience for people. In addition, the rotating shaft member 26*s* provided on the third seat rod 24 and the fourth seat rod 25 can allow the third seat rod 24 and the fourth seat rod 25 to be further bent after the human-pet shared collapsible chair is collapsed, thereby reducing the storage space, allowing the collapsed collapsible chair to be more compact, and reducing the protruding length after bending, thus avoiding scratches to people or pets.

In the present application, the lower end described refers to the end close to the ground when the collapsible chair is deployed for use, and the upper end described refers to the end away from the ground.

Referring to FIGS. 1 to 3, in some embodiments, a transverse bracing rod 6 is further included, the transverse bracing rod 6 includes a first rod segment 61 and a second rod segment 62 pivotally connected to the first rod segment 61, an end of the first rod segment 61 facing away from the second rod segment 62 being pivotally connected to the seventh strut 221, and an end of the second rod segment 62 facing away from the first rod segment 61 being pivotally connected to the eighth strut 222. The second set of rear crossing struts 22 has a locked state and an unlocked state. When the first rod segment 61 is rotated to be in collinear alignment with the second rod segment 62, the transverse bracing rod 6, the seventh strut 221, and the eighth strut 222 enclose a triangle for bringing the second set of rear crossing struts 22 into the locked state; and when the first rod segment 61 is bent relative to the second rod segment 62, constraint on the second set of rear crossing struts 22 is released, at this point, a seventh upper portion and an eighth upper portion are capable of moving close to each other, and the second set of rear crossing struts 22 is brought into the unlocked state.

Preferably, the two ends of the transverse bracing rod 6 in this embodiment are respectively connected to upper portions of the two struts of the second set of rear crossing struts 22, i.e. above the central connected position of the two struts, and the connected positions are on the same horizontal line. Of course, the two ends of the transverse bracing rod 6 may be connect to lower portions of the two struts, i.e. below the central connected position of the two struts, and the connected positions are on the same horizontal line. The transverse bracing rod 6 can be bent upward, i.e. in the unlocked position, to facilitate storage of the collapsible chair, but in the locked position, can only be deployed until the first rod segment 61 and the second rod segment 62 are collinear, and cannot be bent further downward. As a result, when in the locked position, the transverse bracing rod 6 can provide the second set of rear crossing struts 22 with a transverse rigid supporting force to allow the collapsible chair to be less likely to collapse when subjected to lateral forces. It can be understood that since the human-pet shared collapsible chair is of a structure that is collapsed simultaneously and deployed simultaneously, the supporting effect may be provided by providing the transverse bracing rod 6 on one of the sets of crossing struts. The transverse bracing rod 6 may either be provided on the first set of front crossing struts 11, or on the first set of rear crossing struts 12, or on the second set of front crossing struts 21. It is also possible that one transverse bracing rod 6 is provided on each of the four sets of crossing struts, or transverse bracing rod 6*s* are provided on two or three of the sets of crossing struts.

Referring to FIGS. 1 to 4, in some embodiments, the first collapsible linkage mechanism1 includes: a first backrest rod 13, the first backrest rod 13 including a first backrest rod upper end 131 and a first backrest rod lower end 132; a second backrest rod 14, the second backrest rod 14 including a second backrest rod upper end 141 and a second backrest rod lower end 142, the first backrest rod lower end 132 and the second backrest rod lower end 142 being pivotably connected to the second lower end 1142 and the first lower end 1132, respectively, and the first backrest rod upper end 131 and the second backrest rod upper end 141 being pivotably connected to the third upper end 1211 and the fourth upper end 1221, respectively; a first seat rod 15, the first seat rod 15 including a first seat rod upper end 151 and a first seat rod lower end 152, the first seat rod upper end 151 and the central seat rod upper end 31 being pivotably connected to the first upper end 1131 and the second upper end 1141, respectively, and the first seat rod lower end 152 and the central seat rod lower end 32 being pivotably connected to the fourth lower end 1222 and the third lower end 1212, respectively, where the second backrest rod lower end 142 is pivotably connected to the first joint pivoting module a; and the second collapsible linkage mechanism 2 includes: a second seat rod 23, the second seat rod 23 including a second seat rod upper end 231 and a second seat rod lower end 232, the second seat rod upper end 231 and the central seat rod upper end 31 being pivotably connected to the sixth upper end 2181 and the fifth upper end 2171, respectively, the second seat rod lower end 232 and the central seat rod lower end 32 being pivotably connected to the seventh lower end 2212 and the eighth lower end 2222, respectively, the third seat rod upper end 241 and the fourth seat rod upper end 251 being pivotably connected to the seventh upper end 2211 and the eighth upper end 2221, respectively, the fourth seat rod lower end 252 being pivotably connected to the fifth lower end 2172, the first backrest rod 13 and the second backrest rod 14 being equal in length, and the first seat rod 15, the central seat rod 3, the second seat rod 23, the third seat rod 24, and the fourth seat rod 25 being equal in length and less than the first backrest rod 13 and the second backrest rod 14 in length.

The backrest rods of the first collapsible linkage mechanism1 are longer. When seating on the first collapsible linkage mechanism1, a human may lean back for better rest. The second collapsible linkage mechanism 2 is lower than the first collapsible linkage mechanism1, and has no backrest structure, making it convenient for a pet to go up and down from various directions. Moreover, the second collapsible linkage mechanism 2 has a flat seating-lying surface, which is more conducive to playing and resting of the pet thereon.

Referring to FIGS. 1 to 4, in some embodiments, a first connecting rod 111, a central connecting rod 4, a second connecting rod 211, a third connecting rod 212, and a fourth connecting rod 213, and a first slider 112, a central slider 5, a second slider 214, a third slider 215 and a fourth slider 216 are further included, where an upper end of the first connecting rod 111 is pivotably connected to the first seat rod 15, a lower end of the first connecting rod 111 is pivotably connected to the first slider 112, and the first slider 112 is slidably connected to the first backrest rod 13; an upper end of the central connecting rod 4 is pivotably connected to the central seat rod 3, a lower end of the central connecting rod 4 is pivotably connected to the central slider 5, and the central slider 5 is slidably connected to the second backrest rod 14; an upper end of the second connecting rod 211 is pivotably connected to the second seat rod 23, a lower end of the second connecting rod 211 is pivotably connected to the second slider 214, and the second slider 214 is slidably connected to the fourth seat rod 25; an upper end of the third connecting rod 212 is pivotably connected to the third seat rod 24, a lower end of the third connecting rod 212 is pivotably connected to the third slider 215, and the third slider 215 is slidably connected to the central seat rod 3; and an upper end of the fourth connecting rod 213 is pivotably connected to the fourth seat rod 25, a lower end of the fourth connecting rod 213 is pivotably connected to the fourth slider 216, and the fourth slider 216 is slidably connected to the second seat rod 23.

The arrangement of a plurality of connecting rods and a plurality of sliders can provide a supporting force for a plurality of corresponding seat rods and limit the lateral movement of the plurality of corresponding seat rods, such that the collapsible chair has a stronger load-bearing capacity and is less prone to skewing and collapsing, and the collapsible chair is operated smoothly during collapsing and deploying and is entirely more compact.

Referring to FIGS. 1 to 4, in some embodiments, the first joint pivoting module a further includes a pivot base 7, the pivot base 7 includes an inner wall and an outer wall, each of the first lower end 1132, the fourth lower end 1222, the second backrest rod lower end 142, and the third seat rod lower end 242 is pivotably connected to the inner wall, and the outer wall is configured for contact with the ground.

It can be understood that the pivot base 7 can not only provide linked pivoting support, but also provide a flat contact surface of the collapsible chair with the ground, maintaining the stability of the collapsible chair during use. The second joint pivoting module b further has a pivot base 7 with the same function, that is, the second joint pivoting module b further includes a pivot base 7, each of the third lower end 1212, the eighth lower end 2222, and the central seat rod lower end 32 is pivotably connected to the inner wall, and the outer wall is configured for contact with the ground. A pivot base 7 with the same function may also be provided at another rod end that is in contact with the ground to form support.

Referring to FIGS. 1 to 3, in some embodiments, further included are a plurality of pivot member 8*s* for pivotally connecting the first upper end 1131 to the first seat rod 15, the second upper end 1141 to the central seat rod 3, the third upper end 1211 to the first backrest rod 13, the fourth upper end 1221 to the second backrest rod 14, the fifth upper end 2171 to the central seat rod 3, the sixth upper end 2181 to the second seat rod 23, the seventh upper end 2211 to the third seat rod 24, and the eighth upper end 2221 to the fourth seat rod 25.

It can be understood that the plurality of pivot member 8*s* provide a connecting function and a linked pivoting support to allow the collapsible chair to be synchronously collapsed during collapsing, and provide connecting and supporting effects when the collapsible chair is deployed for use.

Referring to FIGS. 1 to 5, in some embodiments, a seat fabric 9 is further included, the seat fabric 9 is removably arranged on the first collapsible linkage mechanism1 and the second collapsible linkage mechanism 2.

It can be understood that the seat fabric 9 can bear a human and a pet when the collapsible chair is deployed, and can be collapsed synchronously when the collapsible chair is collapsed, which facilitates use, and achieves a light weight.

Figure 5:
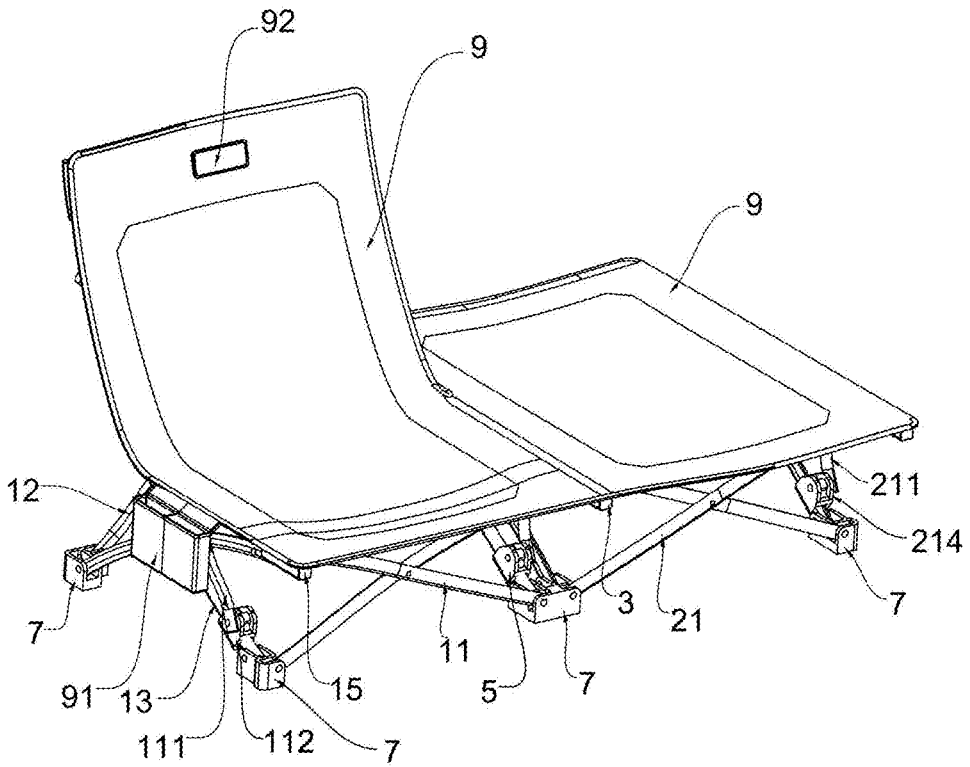
FIG. 5 shows a perspective view of a human-pet shared collapsible chair with a seat fabric according to one of the embodiments in a deployed-for-use state.

Referring to FIG. 5, in some embodiments, a storage bag 91 is provided on an outer side of the first collapsible linkage mechanism1. When the collapsible chair is used outdoors, small personal articles may be put in the storage bag 91, to avoid loss of the articles during playing.

Referring to FIG. 5, in some embodiments, a neck rest 92 is provided on the seat fabric 9 on the first collapsible linkage mechanism1 for bearing a human neck. When a human leans against the seat fabric 9, the neck can be supported, resulting in a better resting experience.

Referring to FIG. 5, in some embodiments, the seat fabric 9 is made of an oxford cloth material. Since the collapsible chair will be collapsed many times during use, the oxford cloth material can not only provide good support and flexibility for collapsing, but also be durable and reliable, with a long service life.

The human-pet shared collapsible chair of the present application combines a collapsible human chair with a collapsible pet bed, during collapsing, the part for a human and the part for a pet can be collapsed simultaneously, such that the collapsing can be completed in one go, the structure is compact, and the collapsing process is smooth, saving time and effort; after being collapsed, the use space and the storage space are also reduced; and when being deployed for use outdoors, the human and the pet are close to each other to enable easier interaction, the shifting or tipping over of the collapsible chair by the pet can also be prevented, and the support rigidity is strong, thereby greatly improving the user experience.

In the description of this specification, descriptions with reference to the terms such as "an embodiment", "some embodiments", "example", "specific example", or "some examples" mean that specific features, structures, materials, or characteristics described with reference to the embodiment or example are included in at least one embodiment or example of the present application. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are merely used for the purpose of illustration, and cannot be construed as indicating or implying relative importance or implicitly indicating the number of technical features indicated. Thus, the features defined with "first" and "second" may explicitly or implicitly include at least one of the features. In the description of the present application, the meaning of "a plurality of" is two or more, unless explicitly and specifically defined otherwise.

The above description is merely specific implementations of the present application, but is not intended to limit the scope of protection of the present application. Any variation or replacement readily figured out by a person skilled in the art within the technical scope disclosed in the present application shall fall within the scope of protection of the present application. Therefore, the scope of protection of the present application shall be subject to the scope of protection of the claims.

What is claimed is:

1. A human-pet shared collapsible chair, comprising:

a first collapsible linkage mechanism, the first collapsible linkage mechanism comprising a first set of front crossing struts and a first set of rear crossing struts arranged opposite the first set of front crossing struts, the first set of front crossing struts comprising a first strut and a second strut rotationally connected to the first strut, the first strut comprising a first upper end and a first lower end arranged opposite each other, the second strut comprising a second upper end and a second lower end arranged opposite each other, the first set of rear crossing struts comprising a third strut and a fourth strut rotationally connected to the third strut, the third strut comprising a third upper end and a third lower end arranged opposite each other, and the fourth strut comprising a fourth upper end and a fourth lower end arranged opposite each other;

a second collapsible linkage mechanism, the second collapsible linkage mechanism comprising a second set of front crossing struts, a second set of rear crossing struts, and a first seat rod and a second seat rod each connected to the second set of front crossing struts and the second set of rear crossing struts, the second set of front crossing struts comprising a fifth strut and a sixth strut rotationally connected to the fifth strut, the fifth strut comprising a fifth upper end and a fifth lower end arranged opposite each other, the sixth strut comprising a sixth upper end and a sixth lower end arranged opposite each other, the second set of rear crossing struts comprising a seventh strut and an eighth strut rotationally connected to the seventh strut, the seventh strut comprising a seventh upper end and a seventh lower end arranged opposite each other, the eighth strut comprising an eighth upper end and an eighth lower end arranged opposite each other, the first seat rod comprising a first seat rod upper end and a first seat rod lower end arranged opposite each other, the second seat rod comprising a second seat rod upper end and a second seat rod lower end, wherein a rotating shaft member is provided in a middle of each of the first seat rod and the second seat rod to allow the first seat rod and the second seat rod to bend relative to themselves when the human-pet shared collapsible chair is in a collapsed state;

a central seat rod, the central seat rod comprising a central seat rod upper end and a central seat rod lower end arranged opposite each other;

a first joint pivoting module, the first lower end, the sixth lower end, and the first seat rod lower end being rotatably connected to the first joint pivoting module;

a second joint pivoting module, the third lower end, the central seat rod lower end and the eighth lower end being rotatably connected to the second joint pivoting module; and a third joint pivoting module, the second upper end, the third upper end and the central seat rod upper end being connected to the third joint pivoting module;

wherein the first collapsible linkage mechanism and the second collapsible linkage mechanism are centered on the central seat rod, and are capable of pivoting relative to each other by means of the first joint pivoting module, the second joint pivoting module and the third joint pivoting module to allow the human-pet shared collapsible chair to jointly switch between a deployed-for-use state and the collapsed state.

2. The human-pet shared collapsible chair according to claim 1, further comprising a transverse bracing rod, the transverse bracing rod comprising a first rod segment and a second rod segment pivotally connected to the first rod segment, an end of the first rod segment facing away from the second rod segment being pivotally connected to the seventh strut, and an end of the second rod segment facing away from the first rod segment being pivotally connected to the eighth strut;

wherein the second set of rear crossing struts has a locked state and an unlocked state;

when the first rod segment is rotated to be in collinear alignment with the second rod segment, the transverse bracing rod, the seventh strut and the eighth strut enclose a triangle for bringing the second set of rear crossing struts into the locked state; and when the first rod segment is bent relative to the second rod segment, constraint on the second set of rear crossing struts is released, at this point, a seventh upper portion and an eighth upper portion are capable of moving close to each other, and the second set of rear crossing struts is brought into the unlocked state.

3. The human-pet shared collapsible chair according to claim 1, wherein: the first collapsible linkage mechanism comprises:

a first backrest rod, the first backrest rod comprising a first backrest rod upper end and a first backrest rod lower end;

a second backrest rod, the second backrest rod comprising a second backrest rod upper end and a second backrest rod lower end, the first backrest rod lower end and the second backrest rod lower end being pivotably connected to the second lower end and the first lower end, respectively, and the first backrest rod upper end and the second backrest rod upper end being pivotably connected to the third upper end and the fourth upper end, respectively;

a third seat rod, the third seat rod comprising a third seat rod upper end and a third seat rod lower end, the third seat rod upper end and the central seat rod upper end being pivotably connected to the first upper end and the second upper end, respectively, and the third seat rod lower end and the central seat rod lower end being pivotably connected to the fourth lower end and the third lower end, respectively, wherein the second backrest rod lower end is pivotably connected to the first joint pivoting module; and the second collapsible linkage mechanism comprises:

a fourth seat rod, the fourth seat rod comprising a fourth seat rod upper end and a fourth seat rod lower end, the fourth seat rod upper end and the central seat rod upper end being pivotably connected to the sixth upper end and the fifth upper end, respectively, the fourth seat rod lower end and the central seat rod lower end being pivotably connected to the seventh lower end and the eighth lower end, respectively, the first seat rod upper end and the second seat rod upper end being pivotably connected to the seventh upper end and the eighth upper end, respectively, and the second seat rod lower end being pivotably connected to the fifth lower end; and the first backrest rod and the second backrest rod are equal in length, the third seat rod, the central seat rod, the fourth seat rod, the first seat rod and the second seat rod are equal in length and less than the first backrest rod and the second backrest rod in length.

4. The human-pet shared collapsible chair according to claim 3, further comprising a first connecting rod, a central connecting rod, a second connecting rod, a third connecting rod, and a fourth connecting rod, and a first slider, a central slider, a second slider, a third slider, and a fourth slider, wherein an upper end of the first connecting rod is pivotably connected to the third seat rod, a lower end of the first connecting rod is pivotably connected to the first slider, and the first slider is slidably connected to the first backrest rod;

an upper end of the central connecting rod is pivotably connected to the central seat rod, a lower end of the central connecting rod is pivotably connected to the central slider, and the central slider is slidably connected to the second backrest rod;

an upper end of the second connecting rod is pivotably connected to the fourth seat rod, a lower end of the second connecting rod is pivotably connected to the second slider, and the second slider is slidably connected to the second seat rod;

an upper end of the third connecting rod is pivotably connected to the first seat rod, a lower end of the third connecting rod is pivotably connected to the third slider, and the third slider is slidably connected to the central seat rod; and an upper end of the fourth connecting rod is pivotably connected to the second seat rod, a lower end of the fourth connecting rod is pivotably connected to the fourth slider, and the fourth slider is slidably connected to the fourth seat rod.

5. The human-pet shared collapsible chair according to claim 3, wherein the first joint pivoting module further comprises a pivot base, the pivot base comprising an inner wall and an outer wall, each of the first lower end, the fourth lower end, the second backrest rod lower end and the first seat rod lower end being pivotably connected to the inner wall, and the outer wall being configured for contact with a ground.

6. The human-pet shared collapsible chair according to claim 3, further comprising a plurality of pivot members for pivotally connecting the first upper end to the third seat rod, the second upper end to the central seat rod, the third upper end to the first backrest rod, the fourth upper end to the second backrest rod, the fifth upper end to the central seat rod, the sixth upper end to the fourth seat rod, the seventh upper end to the first seat rod, and the eighth upper end to the second seat rod.

7. The human-pet shared collapsible chair according to claim 1, further comprising a seat fabric, the seat fabric being removably arranged on the first collapsible linkage mechanism and the second collapsible linkage mechanism.

8. The human-pet shared collapsible chair according to claim 7, wherein a storage bag is provided on an outer side of the first collapsible linkage mechanism.

9. The human-pet shared collapsible chair according to claim 7, wherein a neck rest is provided on the seat fabric on the first collapsible linkage mechanism.

10. The human-pet shared collapsible chair according to claim 7, wherein the seat fabric is made of an oxford cloth material.

* * * * *